United States Patent [19]

Brundage

[11] 4,331,235

[45] May 25, 1982

[54] CONTAINER WITH VENT AND BLANKS FOR FORMING SAME

[75] Inventor: David J. Brundage, Salinas, Calif.

[73] Assignee: Champion International Corporation, Stamford, Conn.

[21] Appl. No.: 182,965

[22] Filed: Sep. 2, 1980

[51] Int. Cl.[3] ..... B65D 85/50

[52] U.S. Cl. ..... 206/423; 229/52 B; 229/DIG. 14

[58] Field of Search ..... 206/527, 491, 423, 1.5; 220/367; 217/42; 229/6 A, 35, 52 B, DIG. 6, DIG. 14

[56] References Cited

U.S. PATENT DOCUMENTS

| | | | |
|---|---|---|---|
| 3,143,275 | 8/1964 | Diggs | 229/52 B |
| 3,387,762 | 6/1968 | Zupon | 229/52 B X |
| 4,163,494 | 8/1979 | Stollberg | 206/423 |
| 4,176,745 | 12/1979 | Stollberg | 206/423 |
| 4,279,374 | 7/1981 | Webinger | 229/DIG. 14 X |

*Primary Examiner*—Steven M. Pollard
*Attorney, Agent, or Firm*—Evelyn M. Sommer

[57] ABSTRACT

A container with a vent arrangement and a blank for forming same has inner and outer trays which are telescoped relative to one another. The venting arrangement includes an inner vent flap on the inner tray and an outer vent flap on the outer tray which are aligned and define apertures in their respective trays. Each vent flap may be selectively opened and closed to control access to the container interior. A locking arrangement is provided on the inner vent flap and on the inner tray for retaining the inner vent flap in an open position in which the inner vent flap holds the outer vent flap in its open position.

5 Claims, 6 Drawing Figures

CONTAINER WITH VENT AND BLANKS FOR FORMING SAME

BACKGROUND OF THE INVENTION

1. Field of the Invention.

The present invention relates to a container having at least one vent which is opened and closed to control communication between the interior and exterior of the container. More particularly, the invention relates to a venting arrangement for a container comprising two telescoping trays in which the outer tray has a hinged flap and the inner tray has a hinged flap that may be locked in an open position in which it also retains the outer tray flap in an open position.

2. Description of the Prior Art.

Cut flowers are pre-cooled before shipment to prolong freshness. The pre-cooling process involves packing the cut flowers in a corrugated container and then forced-air cooling the flowers within the container. For forced-air cooling, vents are provided at opposite ends of the container to permit warm moist air from the flowers to be withdrawn from the container at one end and low temperature air to be introduced from the opposite end. Once the pre-cooling process has been completed, the vents are closed as quickly as possible. Thus, a venting arrangement should be capable of being easily opened and locked in its open position for forced-air cooling and then easily closed by a simple manual operation.

U.S. Pat. Nos. 4,163,494 and 4,176,745 to Stollberg disclose two (2) corrugated containers for forced-air cooling cut flowers. Each of these containers comprise two (2) telescoping trays with each tray having a base panel and side walls extending therefrom. In the first Stollberg patent, open apertures are provided in the inner or bottom tray, while the upper or cover tray has an aperture with a closure flap which may be locked in an open position. The closure flap comprises two (2) segments which are hingedly coupled along a fold line with one of the segments being otherwise free of the container and the other segment hingedly coupled to the container. A notch is provided in the cover tray for retaining the cover closure flap in its open position.

The second Stollberg patent has openings with flaps on both of the cover and bottom trays. In this arrangement, the cover flap may be locked such that it also retains the bottom tray closure flap in an open position. The cover closure flap is similar in construction to the cover closure flap of the first Stollberg patent. The closure flap of the bottom tray has an opening that through which the cover closure flap may extend to lock both flaps in the open position.

The arrangements of the Stollberg patents are deficient in that the arrangement does not provide a sufficiently secure locking of the flaps in their open position. The first Stollberg patent arrangement is deficient in that the vents in the bottom tray are not covered by flaps to seal the bottom tray openings. The second Stollberg patent arrangement is deficient in that the opening of the flaps requires a difficult and cumbersome manipulation.

SUMMARY OF THE INVENTION

Accordingly, it is an object of the present invention to provide a container and a set of blanks for forming a container with a venting arrangement which may be simply and quickly opened and secured in an open position.

Another object of the present invention is to provide a container and a set of blanks for forming a container with a venting arrangement which may be easily and securely resealed to isolate the interior of the container.

An additional object of the present invention is to provide a container and a set of blanks for forming a container with a venting arrangement which is of rugged construction and which is simple and inexpensive to manufacture, assemble and use.

The foregoing objects are obtained by providing a container which comprises an inner tray and an outer tray, each having a base panel and wall panels extending therefrom. A venting arrangement is provided in adjacent inner and outer tray panels and includes aligned inner and outer apertures and vent flaps for controlling access to the carton interior by selectively opening and closing the vent flaps. The vent flaps are hingedly coupled to respective wall panels. A locking arrangement is provided on the inner vent flap and its inner wall panel for retaining the inner vent flap in its open position. The inner vent flap in its open position holds the outer vent flap in its open position.

The foregoing objects are also obtained by a set of blanks for forming a container with at least one vent, which comprises first and second blanks, each having a base panel and wall panels hingedly coupled to edges thereof along fold lines. A first vent flap is formed in one of the first wall panels and has a central portion hingedly coupled to the one first wall panel along a first fold line. Two (2) end portions are hingedly coupled to the central portion along substantially parallel fold lines extending substantially perpendicularly from opposite ends of the first fold line. A second vent flap is formed in and is hingedly coupled to one of the second wall panels along a fold line.

By forming the container and the set of blanks of the present invention in this manner, a container comprising two (2) telescoping trays is provided with an improved venting arrangement. This improved venting arrangement may be easily and quickly opened and secured in an open position. The locking means on the inner vent flap and its inner wall panel securely holds the vent flaps in their open position. Additionally, once the pre-cooling process has been completed, the vent flaps may be easily and securely closed to seal the container.

Other objects, advantages and salient features of the present invention will become apparent from the following detailed description, which taken in conjunction with the annexed drawings, discloses a preferred embodiment of the present invention.

As used in this application, the terms "side", "end", "top", "bottom", and "cover" are intended to facilitate the description of the container and the set of blanks for forming the container. Thus, such terms are merely illustrative of the container and blanks and are not intended to limit the container or blanks to any specific orientation.

BRIEF DESCRIPTION OF THE DRAWINGS

Referring to the drawings which form a part of this original disclosure.

DETAILED DESCRIPTION OF THE PREFERRED EMBODIMENT OF THE INVENTION

Figure 1:
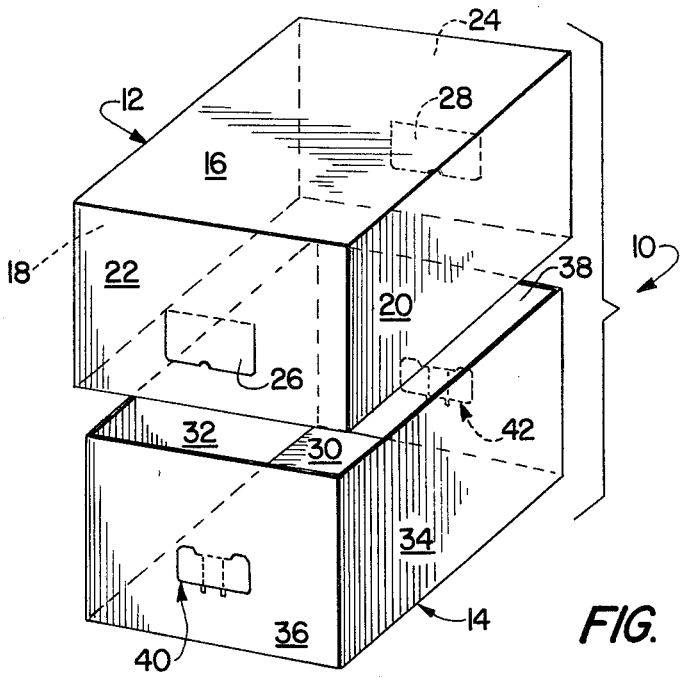
FIG. 1 is a perspective view graphically illustrating the container of the present invention as the cover tray is placed on the bottom tray.

Referring to FIG. 1, the container or carton 10 comprises a cover or outer tray 12 and a bottom or inner tray 14. The cover tray 12 comprises a rectangular base panel 16, opposed rectangular side wall panels 18, 20, and opposed rectangular end wall panels 22, 24. These wall panels depend from the edges of the base panel 16. Outer vent flaps 26, 28 are formed in the end wall panels 22, 24, respectively.

Similarly, the bottom tray 14 comprises a rectangular base panel 30, opposed rectangular side wall panels 32, 34, and opposed rectangular end wall panels 36, 38. These wall panels extend upwardly from the base panel 30. Inner vent flaps 40, 42 are formed in the end wall panels 36, 38, respectively.

The spacing between the panels 18, 20 and the panels 22, 24 is slightly greater than the spacing between the panels 32, 34 and the panels 36, 38, respectively, to permit the cover tray 12 to telescope over the bottom tray 14 to close the container.

Figure 2:
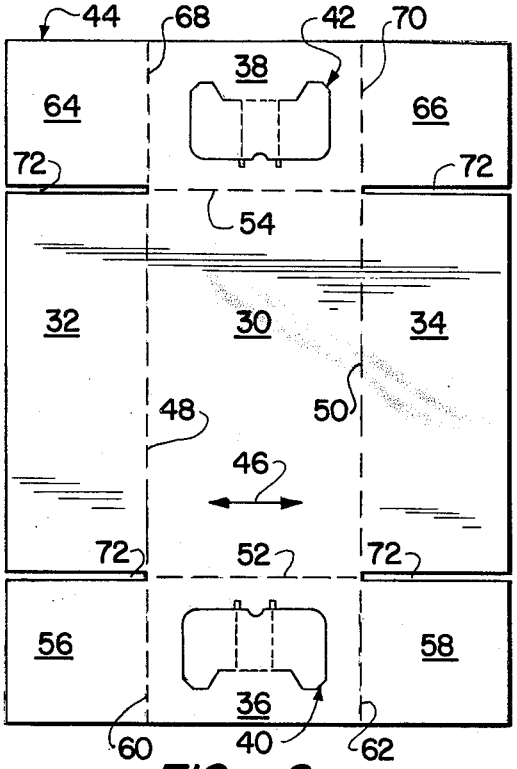
FIG. 2 is a top plan view illustrating the interior surface of a blank for forming the bottom tray of the container of FIG. 1.

The blank 44 for forming the bottom tray 14 of the container 10 is illustrated in FIG. 2. The blank 44 may be formed of a unitary piece of paperboard of suitable weight and thickness, preferably corrugated cardboard. The weight and thickness of the paperboard depends on the size and weight of the contents of the container 10. Preferably, the corrugations run parallel to the line 46. FIG. 2 illustrates the surface of the blank 44 which will form the interior surface of the container 10 illustrated in FIG. 1.

The side wall panels 32, 34 are hingedly coupled to opposite side edges of the base panel 30 along fold lines 48, 50, respectively. End wall panels 36, 38 are hingedly coupled to opposite end edges of the base panel 30 along fold lines 52, 54, respectively.

End wall panel 36 has rectangular corner panels 56, 58 hingedly coupled to opposite side edges thereof along fold lines 60, 62, respectively. Similarly, end wall panel 38 has rectangular corner panels 64, 66 hingedly coupled to opposite side edges thereof along fold lines 68, 70, respectively. The corner panels are separated from the side wall panels 32, 34 by slits 72.

When the bottom tray 14 is assembled from the blank 44, the side wall panels 32, 34 are folded about lines 48, 50 until they are perpendicular to the base panel 30 and the end wall panels 36, 38 are folded about lines 52, 54 until they are perpendicular to the base wall panel 30 and the side wall panels 32, 34. The corner panels 56, 58, 64, 66 are folded about fold lines 60, 62, 68, 70, respectively, to overlie a surface of an adjacent side wall panel 32, 34 and are affixed thereto in a conventional manner, such as by staples, stitching or adhesive.

Figure 3:
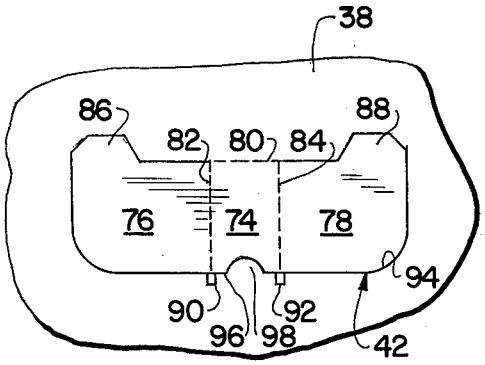
FIG. 3 is an enlarged, partial top plan view illustrating one of the vent flaps of FIG. 2.

Since the inner vent flaps 40, 42 are essentially identical in construction, only one will be described in detail with reference to FIG. 3. Inner vent flap 42 is generally U-shaped and comprises three (3) portions, a central portion 74 and two (2) end portions 76, 78. The central portion 74 is generally rectangular and is hingedly coupled to its end wall panel 38 along a first fold line 80 located along the top edge of the central portion 74. The end portions 76, 78 are hingedly coupled at opposite side edges of the central portion 74 along parallel fold lines 82, 84, respectively. The parallel fold lines 82, 84 extend substantially perpendicularly from the opposite ends of the first fold line 80. The upper sections 86, 88 of the end portions 76, 78, remote from the fold lines 82, 84, respectively, extend upwardly above the first fold line 80.

Two (2) notches 90, 92 are formed in end wall panel 38. The notches are generally rectangular with widths substantially equal to the thickness of the corrugated paperboard. Notch 90 is aligned with fold line 82, while notch 92 is aligned with fold line 84. The notches 90, 92 communicate with the inner opening 94 formed when the inner vent flap 40, 42 is moved to its open position and are located at the ends of the fold lines 82, 84, respectively, remote from the first fold line 80.

The central portion 74 is defined by the fold lines 80, 82, 84 and by the slit 96 interconnecting the ends of fold lines 82, 84 remote from the fold line 80. The slit 96 defines a tab 98 formed from the central portion 74 as an extension of the end wall panel 38. The end portions 76, 78 are defined by slits separating such portions from the end wall panel 38 and by fold lines 82, 84.

Figure 4:
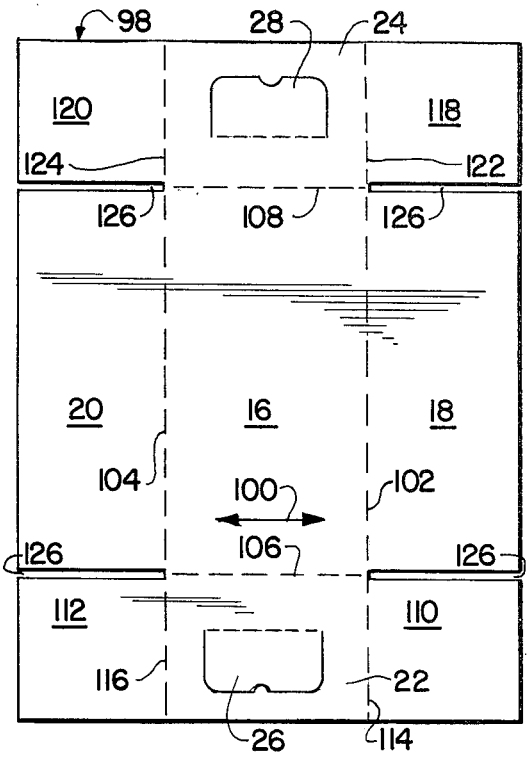
FIG. 4 is a top plan view illustrating the interior surface of a blank for forming the cover tray of the container of FIG. 1.

The second blank 98 illustrated in FIG. 4 forms the cover tray 12 of the container 10. Similar to the blank 44, the blank 98 may be formed of a unitary piece of paperboard of suitable weight and thickness, preferably corrugated cardboard having corrugations running parallel to line 100. FIG. 4 illustrates the surface of the blank 98 which will form the interior surface of the container 10 as illustrated in FIG. 1.

The side wall panels 18, 20 are hingedly coupled along opposite side edges of the base panel 16 along fold lines 102, 104, respectively. The end wall panels 22, 24 are hingedly coupled at opposite end edges of the base panel 16 along fold lines 106, 108, respectively.

Rectangular corner panels 110, 112 are hingedly coupled along opposite side edges of the end wall panel 22 along fold lines 114, 116, respectively. Similarly, end wall panel 24 has rectangular corner panels 118, 120 hingedly coupled at opposite side edges thereof along fold lines 122, 124, respectively. These corner panels are separated from the side wall panels 18, 20 by slits 126.

The cover tray 12 is formed from the blank 98 by folding the side wall panels 18, 20 about lines 102, 104 until the side wall panels are substantially perpendicular to the base panel 16 and by folding the end wall panels 22, 24 about lines 106, 108 until the end wall panels 22, 24 are substantially perpendicular to the base panel 16 and to the side wall panels 18, 20. The corner panels 110, 112, 118, 120 are folded about lines 114, 116, 122, 124 to overlie a surface of an adjacent side wall panel 18, 20 and are affixed thereto in a conventional manner, such as staples, stitches or adhesive.

Figure 5:
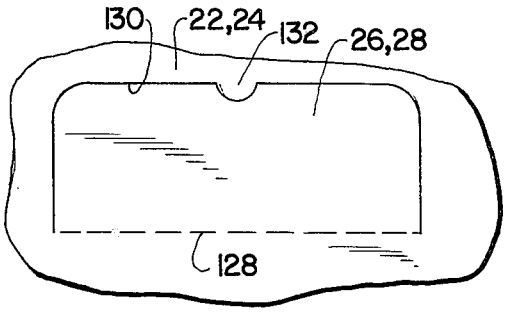
FIG. 5 is an enlarged, partial top plan view illustrating one of the vent flaps of FIG. 4.

The details of the outer vent flaps 26, 28 are illustrated in FIG. 5. Each outer vent flap 26, 28 is generally rectangular in shape and is hinged to its end wall panel 22, 24 at its upper edge along a fold line 128. The remaining periphery of each flap 26, 28 is defined by a slit to separate the remaining portion of the periphery of each flap from its respective end wall panel to form an outer opening 130 in the end wall panels when the flap 26, 28 is folded about line 128. An outer tab 132 is formed from a portion of each flap 26, 28 remote from the fold line 128 as an extension of each end wall panel 22, 24.

After the blanks 44, 98 have been formed into trays as described above, cut flowers or other articles may be placed in the bottom tray 14. Thereafter, the cover tray 12 is placed and telescoped over the bottom tray 14 to enclose the contents.

When the contents of the carton 10 are to be treated, the vent flaps 26, 28, 40, 44 are opened and secured in their open position to provide communication between the exterior and interior of the container 10. Since the operation of the vent at each end of the container 10 is identical, only the vent comprising vent flaps 26, 40 will be described in connection with FIG. 6.

To open the vent flaps 26, 40 force is exerted on outer tab 132 thereby on inner tab 98 until both the inner and outer vent flaps 26, 40 may be gripped and lifted. Outer vent flap 26 is folded about line 128, while inner vent flap 40 is folded about line 80, until such vent flaps are approximately perpendicular to the end panels 22, 36, respectively. The end portions 76, 78 of the inner vent flap 40 are then folded about lines 82, 84 until the ends of the end portions 76, 78 remote from the fold lines 82, 84 are placed and locked within the notches 90, 92, respectively. Folding of the inner vent flap 40 in this manner forms the inner vent flap 40 in a generally U-shape with the bight at the upper portion thereof and the legs depending therefrom. The engagement of the end portions 76, 78 in the notches 90, 92 locks the inner vent flap 40 in its open position illustrated in FIG. 6. Once the inner vent flap 40 is locked in place, the outer vent flap 28 is released until it rests on the free edge (i.e., that edge remote from the first fold line 80) of the central portion 74. Since the inner vent flap 40 is locked in its open position, the outer vent flap will also be locked in its open position by its engagement with the inner vent flap 40.

With the vents at both ends of the container opened, the contents thereof may be treated in a suitable manner (e.g., flowers may be vacuum-cooled by drawing warm, moist air from the flowers through one vent and introducing cooled air through the opposite end vent). Once the processing of the container contents has been completed, the vents can be simply and quickly closed. The vents are closed by releasing the end portions 76, 78 from their respective notches 90, 92 and then folding the vent flaps 40, 26 into their initial coplanar relationship with their respective end wall panels 36, 22. This closes the aligned openings 94, 130 in the end wall panels 36, 22, respectively, to effectively seal the container.

Figure 6:
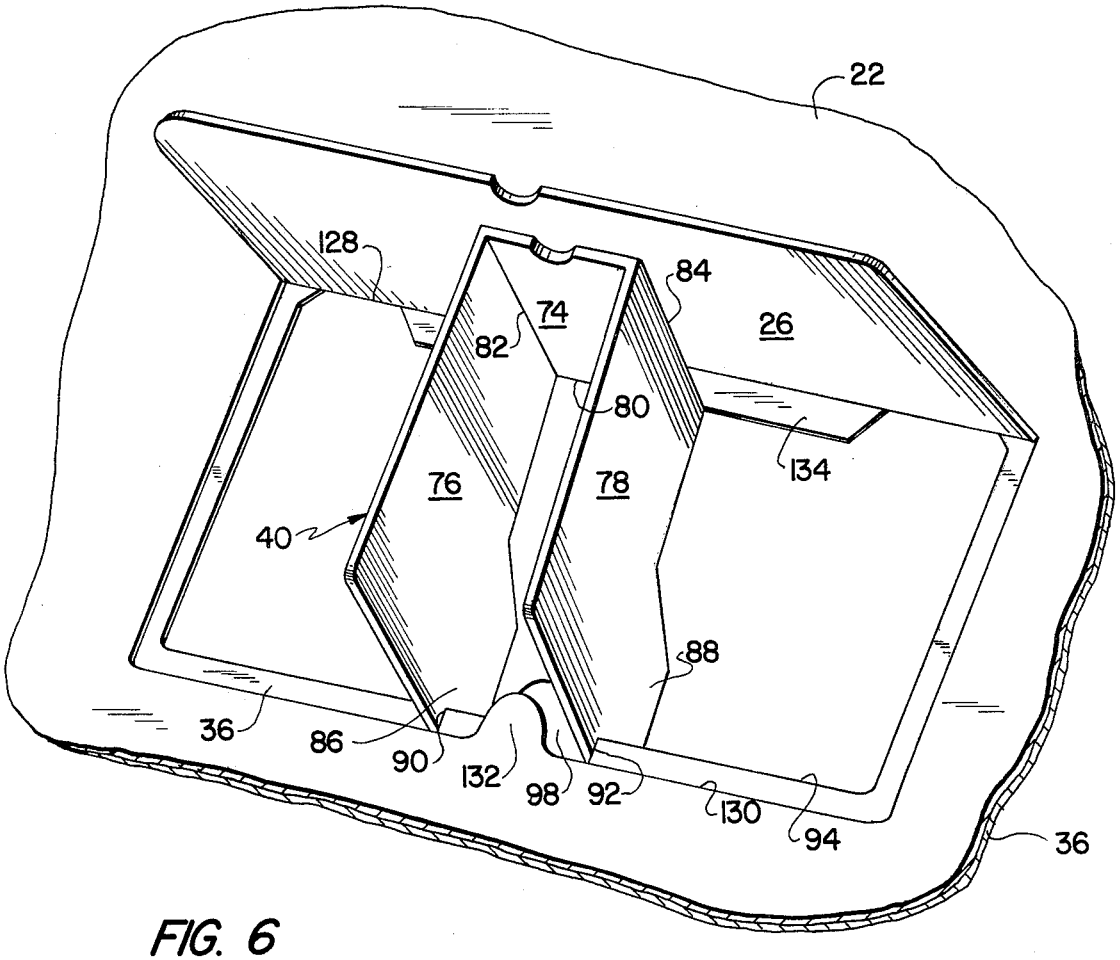
FIG. 6 is a partial, enlarged perspective view of one of the vents of FIG. 1 in its opened and locked position.

As illustrated in FIG. 6, the bottom edges of notches 90, 92 are substantially coplanar with the lower edge of the opening 130 in the end wall panel 22. This relative orientation of the lower edge of the opening 130 to the bottom edges of the notches 90, 92 permits the end portions 96, 98 to bear on such lower edge as well as on the bottom edges of the notches 22. This distributes the forces exerted by the inner vent panel 40 on the end wall panel 36 to decrease a possibility of tearing thereof.

Additionally, when the openings 94, 30 are in their aligned orientation, the first fold line 80 for the inner vent flap 40 is spaced downwardly a short distance from the fold line 128 of the outer vent flap 26 by the flange 134 on the inner end wall panel 36. This enables the vent flaps 26, 40 to be folded about parallel, but spaced, fold lines such that the flaps do not interfere with one another during opening and closing folding movements. Since the fold lines 80, 128 are located on the same side of the median of the openings 94, 130, both the inner vent flap 40 and the outer vent flap 26 move from their closed to open positions by moving in the same direction to permit such vent flaps to be opened simultaneously.

By forming the container and set of blanks of the present invention in this manner, a vent arrangement is provided wherein the vent flaps may be opened and locked quickly and simply and wherein the arrangement may be formed easily and inexpensively. Since the vent flaps may be moved simultaneously to their open position, the opening of the vent arrangement is simplified and can be accomplished more rapidly. Since the outer vent flap bears on the central portion 74 from above, the inherent bias of the flap to resume its coplanar relationship with the end wall panel 22 further forces the end portions 76, 78 into the notches 90, 92 to maintain the security of the locking engagement to retain the vent flaps in their open position. This is contrary to the conventional vent arrangements wherein the vent flap being held open tends to force the locking arrangement out of engagement.

A locking arrangement employing two (2) end portions 76, 78 creates a more positive and stronger locking arrangement over a single end portion arrangement by resisting the development of torques, by providing an additional support member and by providing a more even distribution of stresses. With only one end portion, torques will develop about the single end portion and the forces will be concentrated in a single location tending to cause greater tearing of the container material.

While a particular embodiment has been chosen to illustrate the invention, it will be understood by those skilled in the art that various changes and modifications can be made therein without departing from the scope of the invention as defined in the appended claims.

What is claimed is:

1. A container comprising:

(a) an inner tray having a base panel and wall panels extending therefrom;

(b) an outer tray having a base panel and wall panels extending therefrom, said outer tray wall panels telescoping over said inner tray wall panels; and (c) venting means in adjacent inner and outer tray wall panels including aligned inner and outer apertures therein and vent flaps hingedly coupled thereto along first and second fold lines respectively, for controlling access to the interior of the container by selectively moving said vent flaps between open and closed positions, said inner vent flap comprising a central portion hingedly coupled to the respective inner tray wall panel along said first fold line, and said inner vent flap further comprising two end portions hingedly coupled to said central portion along substantially parallel fold lines extending substantially perpendicularly from opposite ends of said first fold line, and locking means on said inner vent flap and on one edge of one of said inner and outer apertures for retaining said inner vent flap in said open position such that said inner vent flap holds said outer vent flap in said open position.

2. A container according to claim 1, wherein said locking means comprises two notches communicating with said inner aperture, each of said notches being aligned with one of said parallel fold lines for receiving one of said end portions.

3. A container according to claim 2, wherein each said notch has a bottom edge coplanar with an edge of said outer aperture.

4. A set of blanks for forming a container with at least one vent, which comprises:

a first blank including a first base panel, first wall panels hingedly coupled to edges of said first base panel along fold lines, and a first vent flap formed in one of said first wall panels, said first vent flap having a central portion hingedly coupled to said first wall panel along a first fold line and two end portions hingedly coupled to said central portion along substantially parallel fold lines extending substantially perpendicularly from opposite ends of said first fold line; and a second blank including a second base panel, second wall panels hingedly coupled to edges of said second base panel along fold lines, and a second vent flap formed in and hingedly coupled to one of said second wall panels along a fold line.

5. A set of blanks according to claim 4, wherein said one of said first wall panels has notches formed therein aligned with said parallel fold lines at ends thereof remote from said first fold line.

* * * * *